United States Patent [19]

Christensen

[11] 4,365,130

[45] Dec. 21, 1982

[54] VENTED MEMBRANE SWITCH WITH CONTAMINANT SCAVENGER

[75] Inventor: David A. Christensen, Crystal Lake, Ill.

[73] Assignee: North American Philips Corporation, New York, N.Y.

[21] Appl. No.: 334,495

[22] Filed: Dec. 28, 1981

Related U.S. Application Data

[63] Continuation of Ser. No. 81,837, Oct. 4, 1979, abandoned.

[51] Int. Cl.[3] ..... H01H 13/52; H01H 9/02

[52] U.S. Cl. ..... 200/306; 200/159 B; 200/5 A

[58] Field of Search ..... 200/302, 306, 159 B, 200/5 A

[56] References Cited

U.S. PATENT DOCUMENTS

| | | | |
|---|---|---|---|
| 3,898,421 | 8/1975 | Suzumura | 200/159 B |
| 3,995,126 | 11/1976 | Larson | 200/5 A |
| 3,995,128 | 11/1976 | Hawkins | 200/159 B |
| 4,033,030 | 7/1977 | Robinson et al. | 200/5 A |
| 4,046,975 | 9/1977 | Seeger | 200/159 B |
| 4,066,855 | 1/1978 | Zenk | 200/5 A |
| 4,249,044 | 2/1981 | Larson | 200/159 B |

FOREIGN PATENT DOCUMENTS

| | | | |
|---|---|---|---|
| 943001 | 5/1956 | Fed. Rep. of Germany | 200/306 |
| 2346643 | 9/1973 | Fed. Rep. of Germany | 200/306 |

*Primary Examiner*—John W. Shepperd

*Attorney, Agent, or Firm*—James J. Cannon, Jr.

[57] ABSTRACT

A membrane switch, which is vented to equalize air pressures within and outside the switch, includes a scavenger material in the vent passage selected to react with airborne contaminants and prevent or substantially reduce their passage into the area of the switch contacts.

5 Claims, 3 Drawing Figures

VENTED MEMBRANE SWITCH WITH CONTAMINANT SCAVENGER

This is a continuation, of application Ser. No. 81,837, filed Oct. 4, 1979 now abandoned.

BACKGROUND OF THE INVENTION

The present invention relates to switches for use in electronic circuits and, in particular, to switches in which the movement of a flexible membrane closes the switch contacts.

Membrane switches of the mechanical type, in which movement of a flexible membrane simultaneously causes the movement of a conductive member to bridge and close the normally open switch contacts, are well known in the art. Membrane movement is typically provided by light finger pressure which moves an internal conductive member through a small open gap to close the switch.

In the construction of one type of membrane switch, one or both of the switch contacts is incorporated into an insulative substrate which may comprise a film base or a circuit board. The underside of an upper flexible membrane, which overlies the substrate and is spaced from the contact(s) thereon, includes a conductive member which may be the other of the switch contacts or a conductive bridge, either of which is adapted to close the contacts upon depression of the flexible membrane. In either case, there is a small air gap or space between the contact area of the substrate and the conductive underside of the flexible membrane in the normally open position of the switch. Such constructions are shown, for example, in U.S. Pat. No. 3,898,421 and 3,988,551.

Depression of the flexible membrane to close the switch will compress the air or other gas occupying the space between the membrane and substrate. If the air or gas is not allowed to escape, the internal pressure build-up may adversely affect the ease of operation of the switch. Since membrane switches are often used in multiple array in a keyboard, one means of allowing the compressed air or gas to escape is to vent each space to the other switches in the array through a series of interconnected internal venting channels, as disclosed, for example, in U.S. Pat. No. 3,995,126. The switches in this type of keyboard array are sealed from outside air. However, a pressure differential may still develop between the outside air and the air or other gas sealed in the spaces within the switches, particularly through thermal cycling in operation or normal ambient temperature changes. This can result in a "dimpling" of the membrane and inadvertant closing of a switch.

One obvious and well known means of preventing the development of a potentially harmful pressure differential is to vent the internal air spaces within the switches to the atmosphere. However, certain desirable materials useful in the conductive contacts and bridging elements are reactive with ordinary contaminants in the outside air and susceptible to corrosion or tarnishing. The formation of a corrosive or tarnish layer on the switch contacts can cause unreliable operation, unacceptably high resistances and, in the worst situation, may insulate the contacts completely.

Attempts have been made to reduce the formation of tarnish and corrosion on the switch contacts by controlling the venting so that only enough outside air sufficient to equalize the pressure is allowed to enter. Such attempts have only been successful in reducing slightly the tarnish rate. Furthermore, as the vents to the outside are reduced in size to restrict the amount of air entering, they become more susceptible to plugging by dust and other airborne particles.

SUMMARY OF THE INVENTION

In the present invention a membrane switch or a plurality of switches in a keyboard array are vented to the atmosphere. In the vent line between the switches and the opening to the outside there is disposed a scavenger material which reacts with the contaminants in the air entering the switch housing or panel to prevent or substantially reduce their passage into the interior of the switches. The scavenger material preferably comprises the same material from which the switch contacts are made, however, other materials which react with the same contaminants that are desired to be excluded may be used.

DESCRIPTION OF THE PREFERRED EMBODIMENT

Figure 1:
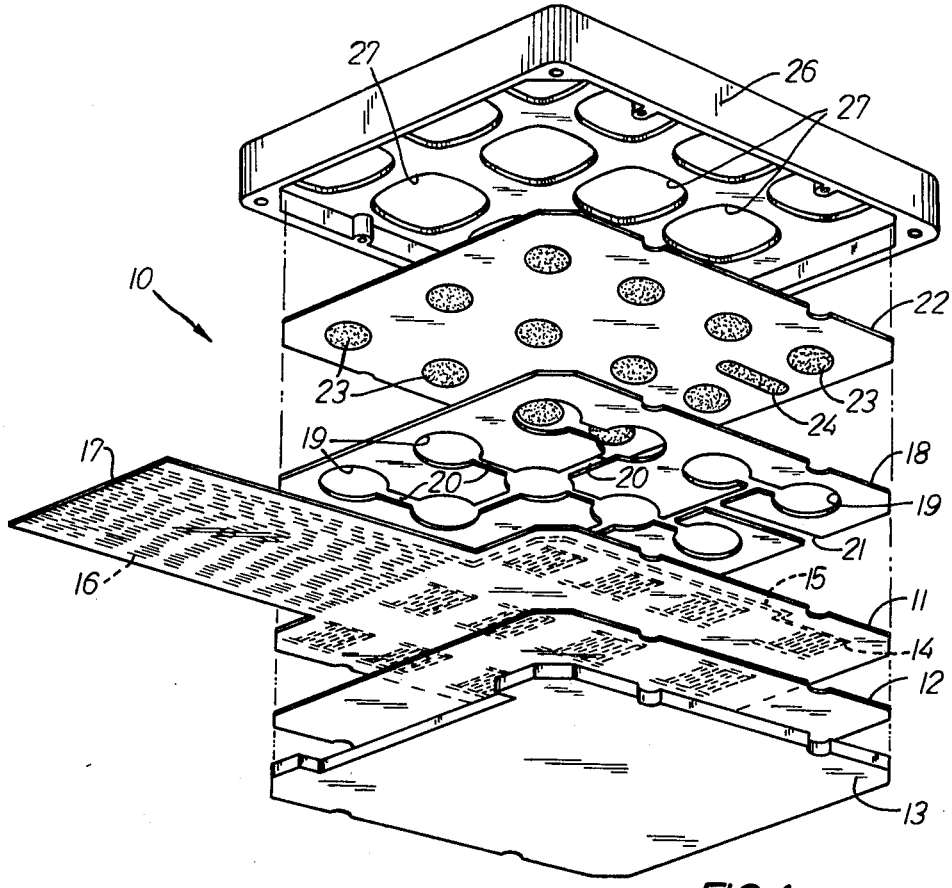
FIG. 1 is an exploded view of a membrane switch in a keyboard array, including the vent channel and scavenger material of the present invention.

The drawing figures show a typical 12-key membrane switch panel or keyboard 10. Referring particularly to FIG. 1, the various components of the panel 10 are shown in an exploded view, since the very thin sections and positions of many of the components make them difficult to show accurately in an ordinary full section. The basic panel 10 includes a bottom substrate which, in the disclosed embodiment, comprises a thin plastic film 11. The substrate is typically made of a sheet of polyester with a thickness of 5 to 7 mils (0.13–0.18 mm.). The substrate 11 may be attached by a suitable lower adhesive layer 12 to a backup board 13 or, alternately, directly to a control panel (not shown).

On the upper surface of the substrate 11, a pattern of conductive switch contacts and leads is applied by silk screening a thin layer of conductive paint, such as silver. In the embodiment shown, a pair of contacts 14 is located at each switch position. Each of the contacts 14 has a multi-finger configuration with the fingers of each contact interfitting those of the other in closely spaced relation. The contacts 14 of each switch are thus normally open. A lead 15 extends from each contact to a terminal 16 on a flexible tail 17 which comprises an integral extension of the substrate 11. One of the leads 15 is typically common and includes a connection to one contact 14 of each switch pair.

A spacer 18 overlies the substrate 11 and is attached thereto by a thin layer of an adhesive (not shown) applied to the surface of the spacer. The spacer 18 may be made from any suitable insulating material, a polyester plastic being the preferred material. The spacer material is typically about 5 mils (0.13 mm.) in thickness and the adhesive layer about 1 mil (0.025 mm.). A series of apertures 19 is provided in the spacer 18, one aperture being disposed at the position of each pair of switch contacts 14. The apertures 19 are interconnected with a network of internal vent channels 20 which, like the apertures 19, are cut completely through the thickness of the spacer material. The vent channels may be of any width adequate to provide the venting to be described in greater detail below; a channel width of 0.050 inch (0.127 cm.) has been found to be sufficient. An outside vent channel 21 extends from one of the internal vent channels 20 to an outer edge of the spacer 18.

Overlying the spacer is a flexible membrane 22 which comprises the movable member for closing the various pair of switch contacts 14. The flexible membrane 22, like the substrate 11 and the spacer 18, is preferably made of a polyester film. The flexible membrane has a thickness in the range of from about 5 to 7 mils (0.13–0.18 mm.), which thickness results from a compromise providing mechanical spring-back and toughness to resist puncturing or other damage and flexibility to provide a light touch sensitivity. The flexible membrane 22 may be attached to the spacer 18 by a thin layer of adhesive (not shown) applied to the upper surface of the spacer.

A series of thin conductive bridges 23 is screened, preferably using silver paint, on the underside of the flexible membrane 18. Other suitable conductive materials and other methods of attaching them to the membrane may also be used. Each conductive bridge 23 is aligned with an aperture 19 in the spacer 18 and is thus also aligned with, but normally separated from, a pair of switch contacts 14. In the embodiment shown, the conductive bridge 23 has a circular shape just slightly smaller than the aperture 19, but large enough to span substantially all of the pair of switch contacts 14 which it overlies.

Figure 2:
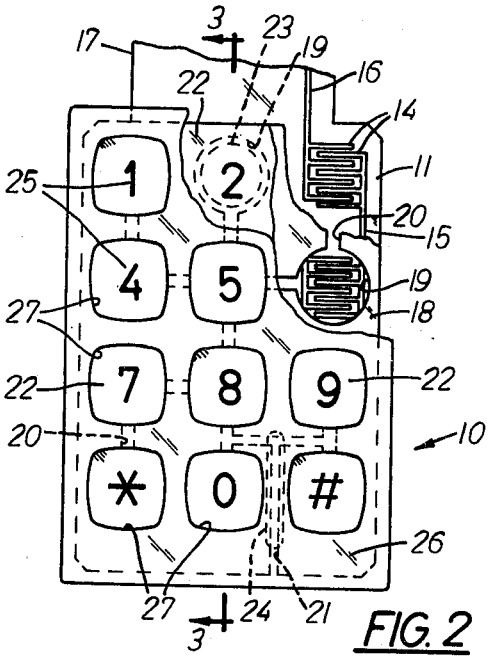
FIG. 2 is a top plan view of the membrane switch key-board of FIG. 1 with portions broken away to show various elements of its construction and the present invention.
Figure 3:
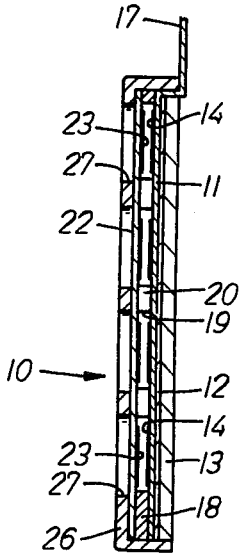
FIG. 3 is a vertical sectional view taken on line 3—3 of FIG. 2, with certain of the vertical dimensions exaggerated for clarity.

Graphics 25 or other indicia may be suitably applied to the upper surface of the flexible membrane, as shown in FIG. 2. The graphics may be applied by screening or with a thin adhesive-backed layer. They may also be applied to the underside of a transparent flexible membrane prior to the screening thereon of the conductive bridges 23.

Preferably at the same time that the conductive bridges are applied to the underside of the flexible membrane, a thin strip of a scavenger material 24 is also applied. The scavenger material is preferably the same as the conductive bridges 23 and the switch contacts 14 and leads 15, i.e. silver. The scavenger material 24 is positioned to overlie the outside vent channel 21 formed in the spacer 18 and, when the flexible membrane is adhesively attached to the spacer, to provide the upper wall of the vent channel.

A completely operative switch panel 10 is provided by the adhesive lamination of three basic parts, namely, the lower substrate 11 (with the screened contacts 14 and leads 15); the intermediate spacer 18 (with the apertures 19 and vent channels 20 and 21); and, the upper flexible membrane 22 (with the conductive bridges 23 and scavenger material 24). As previously described, however, it may be desirable to mount the switch panel to a backup board 13. In addition, the enclosure of the panel may be completed by the use of a bezel 26 which overlies the flexible membrane 22, encloses the edges of the laminated panel, and is attached to the backup board. The bezel 26 includes openings 27 in the surface thereof at each switch position to facilitate finger-actuation of the individual switches and to conveniently separate them.

In operation, a switch is closed by depressing the flexible membrane 22 and causing the conductive bridge 23 to be deflected through the aperture 19 in the spacer 18 and to span and connect the interfitting fingers of the pair of contacts 14. The distance through which the membrane must be moved is very small, comprising essentially only the thickness of the spacer 18 which, in the embodiment described, is 5 mils (0.13 mm.). In spite of the small distance through which the flexible membrane 22 is moved, there is nevertheless a compression of the air within the chamber defined by the periphery of the aperture 19, the lower substrate 11 and the upper flexible membrane 22. Although this air may be internally vented via the network of internal vent channels 20 to the chambers of the other switches, it is known that external venting is preferable to provide a more even internal pressure distribution and, additionally, to eliminate the creation of an internal-external pressure differential with resultant unreliability of switch operation.

The exposure of the internal conductive switch members, particularly the contacts 14 and bridges 23, to outside air may result in the formation of a layer of corrosion or tarnish thereon. If the conductive members are silver, as in the preferred embodiment, the normal presence in air of sulfur dioxide, hydrogen sulfide, or other compounds or forms of sulfur will rapidly cause the formation of a layer of silver sulfide tarnish on these members. However, by interposing the scavenger material 24 in the outside vent channel 21, between the internal conductive members and the outside air, the sulfur or sulfur compounds in the air will react initially with the silver scavenger material, such that the outside air eventually reaching the internal conductive contacts 14 and bridges 23 will be substantially free of tarnish-forming sulfur or compounds thereof.

Although silver is particularly reactive with sulfide-forming contaminants in the air, it will be appreciated that other metals suitable for use as internal conductive components in switches may, likewise, be susceptible to some form of corrosion or tarnishing. Thus, a scavenger material may be used to protect components formed from various metals against corrosion or tarnish caused by air-borne contaminants of various kinds. Typically the scavenger material is the same as the conductive material which is to be protected against tarnishing. However, the scavenger material may include any other material which is reactive with the contaminants that are desired to be excluded from the switch interior.

The scavenger material 24 should be of sufficient length to provide an adequate contact surface for the outside air and must, of course, be interposed directly between the outside air and any components of the switch which are to be protected from tarnishing. It has been found that a scavenger material 24 comprising a screened silver layer approximately 1 inch (2.54 cm.) in length is adequate to protect the internal contacts 14 and bridges 23 from the formation of tarnish. With an outside vent channel 21 having a width of 0.050 inch (0.127 cm.), the scavenger material surface area is 0.050 square inch (0.323 sq. cm.). The cross sectional area of the outside vent channel (with a spacer 18 thickness of 0.005 inch or 0.013 cm.) is 0.00025 square inch (0.00165 sq. cm.). Although the vent opening is quite small, it has been found to be adequate to provide the desired venting and internal-external pressure equalization.

The scavenger material 24 may be alternately or additionally applied to the substrate 11 in the same manner as it is screened onto the flexible membrane 22 in the preferred embodiment. It is also possible to vent the switch panel through either the lower substrate or the upper flexible membrane. In either case, a single small hole through the substrate or membrane near the end of the scavenger material 24 most remote from the internal conductive members would suffice. The area of the vent hole should approximately equal the cross sectional area of the outside vent channel 21.

A test of the present invention was conducted on a vented membrane switch having screened silver internal contacts and scavenger material. The external vent channel and scavenger width were proportionately larger than in the preferred embodiment described above; the channel had cross sectional dimensions of 0.100″×0.0075″ (0.254 cm.×0.019 cm.) and the scavenger material, 1 inch in length, had a surface area of 0.100 sq. in. (0.645 sq. cm.). The switch was tested in a sulfur atmosphere containing 0.1% hydrogen sulfide at 65° C. and 80% relative humidity. After 189 hours in that atmosphere, the internal contacts showed no evidence of tarnish.

I claim:

1. In a membrane switch assembly of the type including an insulating substrate having attached to its inner surface first conductive contact portions of a plurality of switches; an insulating spacer layer overlying and secured to said substrate and having a plurality of apertures therein, each providing open access to the first conductive contact portion of one of said switches, and said spacer layer including a network of internal vent channels interconnecting and providing open communication between said apertures; and, a flexible membrane overlying and secured to said spacer layer and having attached to its inner surface second conductive contact portions of said switches, each of said second conductive contact portions being disposed in alignment with one of said apertures and first conductive contact portions and spaced from the latter such that each of said switches is normally open; the improvement comprising:

(a) an external vent channel in said spacer layer providing open communication between the atmosphere outside of the switch assembly and one of said internal vent channels;

(b) said external vent channel angularly intersecting said internal vent channel and having a length of at least one inch;

(c) said external vent channel being dimensioned to achieve pressure equilization between said internal vent channels and said external atmospheric pressure;

(d) a contact contaminant scavenger material disposed said external vent channel; and (e) said first and second contact portions and said contact contaminants scavenger being materials which are reactant to the same contaminants such that said scavenger functions as a sacrifical material preventing undesirable reactant substances from reaching said contact portions.

2. The invention of claim 1 wherein said first and second conductive portions and said contact contaminant scavenger are comprised of the same material.

3. The invention of claim 2 wherein said first and second conductive contact portions and said contact contaminant scavenger are comprised of silver.

4. The invention of claim 1 wherein said contact contaminant scavenger is disposed on the inner surface of either said substrate or said flexible membrane and forms a portion of one wall of said vent channel.

5. The invention of claim 1 wherein said first and second conductive contact portions are screened onto said surfaces of said insulating substrate and said flexible membrane, respectively, and said scavenger material is screened onto one of said surfaces.

* * * * *

UNITED STATES PATENT AND TRADEMARK OFFICE

CERTIFICATE OF CORRECTION

PATENT NO. : 4,365,130

DATED : December 21, 1982

INVENTOR(S) : DAVID A. CHRISTENSEN

It is certified that error appears in the above—identified patent and that said Letters Patent is hereby corrected as shown below:

In the claims:

Column 6, Claim 1, Clause D, Line 2

After "posed" insert --within--

Column 6, Claim 1, Clause e, Line 2

"contaminants" should be --contaminant--

Signed and Sealed this

Tenth Day of January 1984

[SEAL]

*Attest:*

GERALD J. MOSSINGHOFF

*Attesting Officer*

*Commissioner of Patents and Trademarks*